US008778089B2

(12) United States Patent
Park et al.

(10) Patent No.: US 8,778,089 B2
(45) Date of Patent: Jul. 15, 2014

(54) DISHWASHER AND A CONTROL METHOD THEREFOR

(75) Inventors: Nung Seo Park, Changwon-si (KR); Gyeong Ho Moon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 13/130,081

(22) PCT Filed: Nov. 10, 2009

(86) PCT No.: PCT/KR2009/006588
§ 371 (c)(1),
(2), (4) Date: Nov. 1, 2011

(87) PCT Pub. No.: WO2010/053336
PCT Pub. Date: May 14, 2010

(65) Prior Publication Data

US 2012/0037186 A1 Feb. 16, 2012

(30) Foreign Application Priority Data

Nov. 10, 2008 (KR) ..... 10-2008-0111132

(51) Int. Cl.
*B08B 7/04* (2006.01)

(52) U.S. Cl.
USPC ..... 134/18; 134/42; 134/56 D; 134/57 D; 134/58 D; 134/105; 134/108; 68/12.03; 68/12.21; 68/12.22

(58) Field of Classification Search
CPC ..... A47L 2401/10
USPC .... 8/158, 159; 134/18, 42, 56 D, 57 D, 58 D, 134/105, 108; 68/12.03, 12.21, 12.22
See application file for complete search history.

(56) References Cited

U.S. PATENT DOCUMENTS 5,555,583 A * 9/1996 Berkcan ..... 8/158
5,560,060 A * 10/1996 Dausch et al. ..... 8/158

(Continued)

FOREIGN PATENT DOCUMENTS

DE 196 51 344 6/1998
DE 102 53 017 6/2004

(Continued)

OTHER PUBLICATIONS

International Search Report issued in PCT Application No. PCT/KR2009/006588 dated Jul. 10, 2010.

(Continued)

*Primary Examiner* — Bibi Carrillo
(74) *Attorney, Agent, or Firm* — KED & Associates LLP

(57) ABSTRACT

In the dishwasher and the control method therefor of the present invention, the turbidity of washing water is measured and, if it is decided that the level of dirtiness of the tableware is low, then the time over which a heater operates during the washing routine is reduced and, instead, the time over which the heater operates during the rinsing routine is increased. This is advantageous in that it can improve the performance of the drying which is carried out after the rinsing routine. Further, if it is decided that the level of dirtiness of the tableware is high, then the time over which the heater operates during the washing routine is increased and the time over which the heater operates during the rinsing routine is reduced. This is advantageous in that the washing performance can be improved while the overall heater operating time can be maintained.

10 Claims, 3 Drawing Sheets

(56) References Cited

U.S. PATENT DOCUMENTS

| | | | | |
|---|---|---|---|---|
| 5,603,233 | A * | 2/1997 | Erickson et al. | 68/12.02 |
| 8,540,820 | B2 * | 9/2013 | Allen et al. | 134/18 |
| 2004/0118435 | A1 * | 6/2004 | Jung et al. | 134/18 |
| 2013/0092189 | A1 * | 4/2013 | Tang | 134/18 |

FOREIGN PATENT DOCUMENTS

| | | |
|---|---|---|
| FR | 2 692 286 | 12/1993 |
| JP | 07-184821 | 7/1995 |
| JP | 08-019505 | 1/1996 |
| KR | 10-2006-0099488 | 9/2006 |
| KR | 10-0716349 | 5/2007 |
| KR | 10-0772223 | 11/2007 |
| KR | 10-2008-0050842 | 6/2008 |

OTHER PUBLICATIONS

Korean Notice of Allowance dated Jun. 13, 2011. (Application No. 10-2008-0111132).
Chinese Office Action dated Jan. 21, 2013.
European Search Report dated Oct. 2, 2012.

* cited by examiner

DISHWASHER AND A CONTROL METHOD THEREFOR

BACKGROUND OF THE INVENTION

1. Field of the Invention

The present invention relates to a dishwasher and a control method therefor. More specifically, the present invention relates to a dishwasher and a control method therefor capable of improving washing performance and drying performance by adjusting operation time of a heater according to turbidity of washing water.

2. Description of the Related Art

A dishwasher is a device washing contaminants such as food wastes adhering to dishes or cooking tools (in what follows, they are called "dishes") by using a detergent and washing water.

The dishwasher comprises a main body including a washing tub; and a door opening or closing an opening part of the main body, a rack assembly where dishes are loaded, being disposed inside the washing tub; a sump in which washing water is stored, being disposed in a lower part of the washing tub; a washing pump pumping washing water stored in the sump; a washing motor driving the washing pump; and spray nozzles spraying washing water pumped from the washing pump to the washing tub. The dishwasher further comprises a heater for heating washing water. The heater can be installed inside the sump.

The operating sequence of the dishwasher comprises a preliminary and a main wash; rinsing and heated rinsing; and drying routine. At the time of the main wash and the heated rinsing, the heater is operated and thus, heated washing water is supplied inside the washing tub. If the washing motor is operated, the dishwasher pumps washing water from the sump. The pumped washing water is sprayed toward the rack assembly inside the washing tub through the spray nozzles, thereby washing or rinsing dishes put in the rack assembly.

However, conventional dishwashers maintain heating of washing water at a constant level irrespective of turbidity of washing water, limiting improvement of washing and drying performance.

SUMMARY OF THE INVENTION

Technical Problem

The invention has been made in an effort to provide a dishwasher and a control method therefor capable of improving washing and drying performance by controlling operation of a heater according to turbidity of washing water.

Technical Solution

A dishwasher according to the present invention comprises a washing tub to which dishes are loaded; a sump disposed in a lower part of the washing tub and storing washing water temporarily; a heater disposed inside the sump and heating washing water; a turbidity sensor disposed inside the sump and measuring turbidity of washing water; and a controller performing on-off control of the heater to adjust temperature of washing water according to the turbidity of the washing water measured by the turbidity sensor.

In the present invention, the dishwasher, being disposed inside the sump, can further comprise a temperature sensor measuring temperature of washing water.

In the present invention, the controller receives signals from the turbidity sensor and the temperature sensor; and during a washing routine, can perform on-off control of the heater so that temperature of washing water is proportional to the turbidity of the washing water.

In the present invention, the controller can control the time at which the heater is turned on during a rinsing routine so that it is inversely proportional to the time at which the heater is turned on during a washing routine.

In the present invention, the controller, by performing on-off control of the heater according to turbidity of washing water, can increase or decrease the operation time of the heater during the washing and the rinsing routine.

In the present invention, the controller can control the total operation time of the heater to be constant during the operation of the dishwasher.

Also, a method for controlling a dishwasher according to the present invention comprises turbidity measuring and heater control which changes operation time of a heater according to measured turbidity.

In the present invention, the heater control can change operation time of a heater according to turbidity during a washing routine according to turbidity and during a rinsing routine, while keeping the total operation time of the heater to be constant during the operation of the dishwasher.

In the present invention, the heater control can control in such a way that sum of heat energy of the heater during a washing routine and heat energy of the heater during a rinsing routine is always kept to be constant.

In the present invention, the heater control, if turbidity measured at the turbidity measuring is below a predetermined value, can reduce the operation time of the heater during a washing routine.

In the present invention, the heater control, if turbidity measured at the turbidity measuring is below a predetermined value, can increase the operation time of the heater during a rinsing routine.

In the present invention, the heater control, if turbidity measured at the turbidity measuring exceeds a predetermined value, can increase the operation time of the heater during a washing routine.

In the present invention, the heater control, if turbidity measured at the turbidity measuring exceeds a predetermined value, can reduce the operation time of the heater during a washing routine.

In the present invention, the heater control can set the operation time of the heater during a washing routine to be proportional to the turbidity measured at the turbidity measuring.

In the present invention, the heater control can set the operation time of the heater during a rinsing routine to be inversely proportional to the turbidity measured at the turbidity measuring.

In the present invention, the heater control can set the operation time of the heater during a rinsing routine to be inversely proportional to the operation time of the heater during the washing routine.

In the present invention, the method for controlling a dishwasher, before the turbidity measuring, can further comprise a preliminary wash providing washing water while a heater is turned off.

Also, a method for controlling a dishwasher according to the present invention can comprise a preliminary wash turning off a heater and washing dishes; turbidity measuring for measuring turbidity of washing water after the preliminary wash has been carried out; a main wash for washing dishes, where, if the measured turbidity is below a predetermined value, the heater is turned on for a first predetermined period of time and if the measured turbidity exceeds the predetermined value, the heater is turned on for a third predetermined period of time longer than the first predetermined period of time; plain rinsing for turning off the heater and rinsing dishes after the main wash; and heated rinsing for rinsing dishes after the plain rinsing, where, if the measured turbidity is below a predetermined value, the heater is turned on for a second predetermined period of time and if the measured turbidity exceeds the predetermined value, the heater is turned on for a fourth predetermined period of time shorter than the second predetermined period of time.

In the present invention, the sum of the first predetermined period of time and the second predetermined period of time can be controlled to be equal to the sum of the third predetermined period of time and the fourth predetermined period of time.

In the present invention, if the heated rinsing is completed, drying dishes can be further included.

A dishwasher and a control method therefor according to the present invention measures turbidity of washing water and if it is determined that the dirtiness level of dishes is low, increases operation time of a heater during a rinsing routine instead of reducing operation time of the heater during a washing routine, thereby improving drying performance carried out after the rinsing routine.

Also, if the dirtiness level of dishes is high, by increasing operation time of the heater during the washing routine and reducing operation time of the heater during the rinsing routine, total operation time of the heater is maintained while improving washing performance.

DETAILED DESCRIPTION OF THE INVENTION

In what follows, an embodiment of the present invention will be described with reference to appended drawings.

Figure 1:
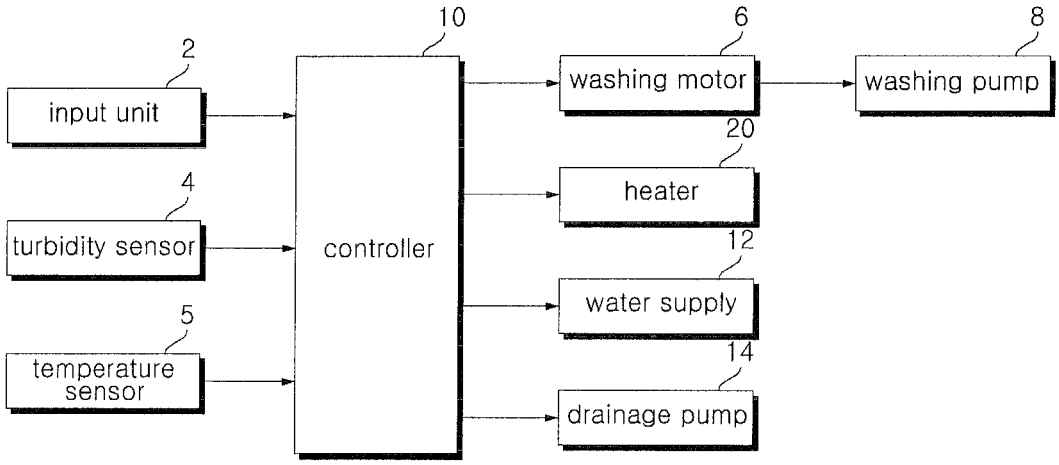
FIG. 1 is a block diagram of a dishwasher according to an embodiment of the present invention.

FIG. 1 is a block diagram of a dishwasher according to an embodiment of the present invention.

A dishwasher according to the present invention comprises a washing tub receiving a rack assembly in which dishes are placed and forming space for washing; a sump disposed in a lower part of the washing tub and storing washing water temporarily; a water supply 12 for supplying water to the sump; a washing pump 8 pumping washing water from the sump and supplying the water to the washing tub; and a drainage pump 14 for draining washing water inside the sump to the outside by pumping the washing water.

The dishwasher further comprises an input unit 2 for receiving information about a washing course or whether to operate from the user. The input unit 2 comprises multiple units with different functions from each other.

The dishwasher further comprises a turbidity sensor 4 disposed inside the sump and measuring turbidity, namely dirtiness, of washing water, a temperature sensor 5 disposed inside the sump and measuring temperature of washing water; and a controller 10 controlling operation of the dishwasher according to the turbidity measured by the turbidity sensor 4.

Also, the dishwasher further comprises a heater 20 disposed inside the sump and heating washing water supplied from the water supply 12.

The washing pump 8 is disposed in a lower part of the sump and a washing motor 6 for operating the washing pump 8 is connected to the washing pump 8.

The turbidity sensor 4 is installed inside the sump. The turbidity sensor 4 comprises a light emitting unit which emits light to the outside and a light receiving unit which detects the light emitted from the light emitting unit. The light detected at the light receiving unit is converted to a predetermined voltage value and thus delivered to the controller. At this time, the voltage level indicates a turbidity value. If a contaminant lies between the light emitting unit and the light receiving unit, light emitted from the light emitting unit is blocked by the contaminant; therefore, part of the light reaches the light receiving unit. In this case, the voltage value delivered to the controller 10 becomes small. Therefore, the controller 10 can determine that turbidity of washing water is high when the voltage value delivered to the controller 10 gets small.

The controller 10 can control the washing pump 8, a water supply 12, a heater 20, a drainage pump 14, and so on according to the signal of the input unit 2.

Also, the controller 10 can control the operation of the heater 20 in such a way that heating time and heating temperature of washing water can be adjusted according to the measured value by the turbidity sensor 4.

A preset value or a preset range for turbidity can be stored beforehand in the controller 10; the controller 10 can compare the preset value or the preset range can be compared with turbidity measured at the turbidity sensor 4. Therefore, the controller 10 determines whether the turbidity measured at the turbidity sensor 4 falls within the preset range or exceeds the preset range; and accordingly, controls the operation time or heating temperature of the heater 20.

The controller 10 can increase or decrease the operation time of the heater 20 and at the same time, can increase or decrease the heating temperature of the heater 20. In the present embodiment, it is assumed that the controller 10 increases or decreases the operation time of the heater 20.

Also, the controller 10 controls the operation time of the heater 20 during a washing routine and the operation time of the heater 20 during a rinsing routine differently according to the turbidity of the washing water.

Figure 2:
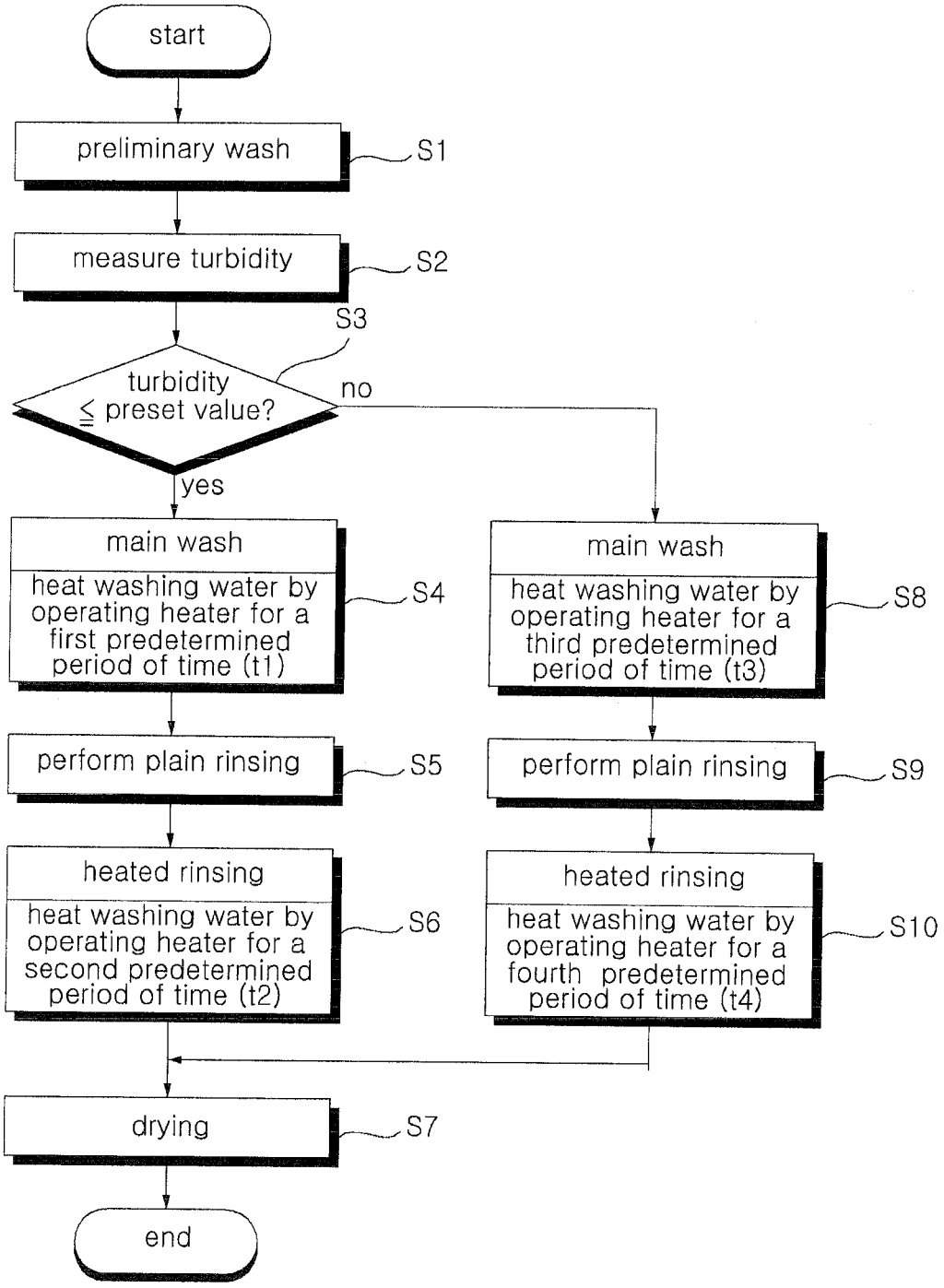
FIG. 2 is a flow diagram illustrating an operational sequence of a dishwasher according to an embodiment of the present invention.
Figure 3:
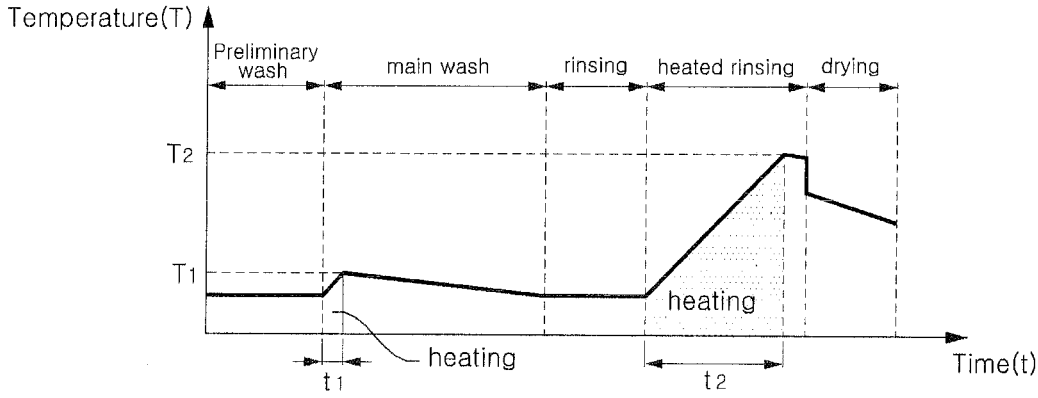
FIG. 3 is a graph illustrating operation time of a heater when a dirtiness level of dishes is high in a dishwasher according to an embodiment of the present invention.
Figure 4:
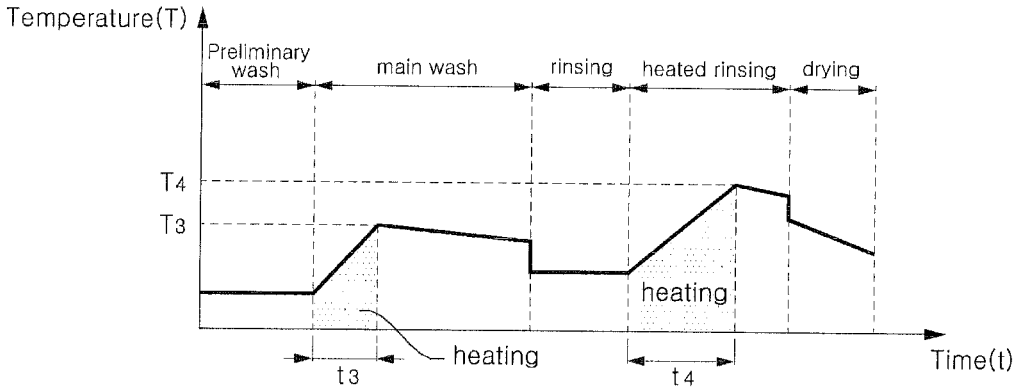
FIG. 4 is a graph illustrating operation time of a heater when a dirtiness level of dishes is low in a dishwasher according to an embodiment of the present invention.

FIG. 2 is a flow diagram illustrating an operational sequence of a dishwasher according to an embodiment of the present invention. FIG. 3 is a graph illustrating operation time of a heater when a dirtiness level of dishes is high in a dishwasher according to an embodiment of the present invention; and FIG. 4 is a graph illustrating operation time of a heater when a dirtiness level of dishes is low in a dishwasher according to an embodiment of the present invention.

First, the user selects a washing course through the input unit 2 and presses an operation button If the operation button is turned on, washing water is supplied and a preliminary wash routine is carried out S1 as the washing pump starts to operate.

The preliminary wash routine is intended for drenching dishes with washing water or removing foreign matters on the dishes. In the preliminary wash routine, the heater is in the state of being turned off and un-heated washing water is supplied.

Meanwhile, turbidity of washing water can be measured before the preliminary wash routine and also measured after the preliminary wash routine. In the present embodiment, it is assumed that turbidity of washing water is measured after the preliminary wash routine.

The turbidity sensor 4 measures turbidity of washing water and delivers the measured value to the controller S2. At this time, the turbidity sensor 4 measures turbidity multiple times and an average value of the measured turbidity values can be selected. It is decided that dirtiness of dishes is high in proportion to the magnitude of the turbidity value measured at the turbidity sensor 4.

If the preliminary wash routine is terminated, a main preliminary wash routine is carried out. At the time of the main wash routine, the heater heats washing water for a predetermined period of time and supplies heated washing water to the washing tub.

The controller 10 controls operation time of the heater during the main wash routine according to turbidity value measured at the turbidity sensor. Since it is determined that dirtiness of dishes is high in proportion to the size of turbidity value, dish washing can be made to be carried out more efficiently by increasing operation time of the heater 20 and thus increasing the temperature of washing water. Operation time of the heater 20 can be controlled to be proportional to the turbidity value measured at the turbidity sensor 4. At this time, it is assumed that the operation time of the heater 20 is determined by comparing the measured turbidity value with a preset value stored in the controller 10 S3.

If the turbidity value measured at the turbidity sensor 4 is below a preset value, it is determined that dirtiness of dishes is low.

With reference to FIG. 3, washing water is heated S4 by operating the heater 20 for a first predetermined period of time t1 during the main wash routine. If the heater 20 is operated for the first predetermined period of time t1, temperature of the washing water reaches a first temperature T1. At this time, the first predetermined period of time t1 can be set to be proportional to measured turbidity.

If the main wash routine is terminated, a plain rinsing routine is performed S5. During the plain rinsing routine, the heater 20 is turned off. The plain rinsing routine is carried out for a predetermined time.

If the plain rinsing routine is terminated, a heated rinsing routine is performed. During the heated rinsing routine, the heater is turned on and washing water is heated for a second predetermined period of time t2; dishes are rinsed as heated washing water is supplied inside the washing tub S6.

During the heated rinsing routine, the heater 20 is operated for the second predetermined period of time t2 and thus washing water is heated. If the heater 20 is operated for the second predetermined period of time t2, temperature of washing water reaches a second temperature T2. The second predetermined period of time can be set longer than the first predetermined period of time t1.

Also, since total operation time of the heater 20 for the dishwasher to operate for one cycle is predetermined, the second predetermined period of time t2 corresponds to the total operation time of the heater subtracted by the first predetermined period of time t1.

If washing water is heated by operating the heater during the heated rinsing routine, time required for a drying routine carried out subsequent to the heated rinsing routine can be reduced, whereby drying performance is improved.

If the heated rinsing routine is terminated, a drying routine is carried out S7.

Therefore, if turbidity of washing water is low, it is decided that dirtiness of dishes is low; heat energy of the heater 20 intended for the main wash routine can be reduced and the heat energy corresponding to the amount saved can be supplied to the heated rinsing routine.

If dirtiness of dishes is low, washing can be performed efficiently even if heat energy of the heater 20 is reduced during the main wash routine. If more heat energy is provided to the heated rinsing routine, time required for the drying routine can be reduced.

Meanwhile, if turbidity measured by the turbidity sensor exceeds a predetermined value, it is decided that dirtiness of dishes is high.

With reference to FIG. 4, washing water is heated by operating the heater 20 for a third predetermined period of time t3 longer than the first predetermined period of time. If the heater is operated for the third predetermined period of time t3, temperature of washing water reaches up to a third temperature T3. In other words, since dirtiness of dishes is high, it is intended to improve washing performance S8 by providing much more heat energy of the heater to the main wash routine where dishes are washed.

If the main wash routine is terminated, plain rinsing is carried out while the heater is turned off S9.

If the plain rinsing is terminated, a heated rinsing routine is carried out. Since the turbidity exceeds the predetermined value, washing water is heated by operating the heater 20 or a fourth predetermined period of time t4 shorter than the second predetermined period of time t2. If the heater 20 is operated for the fourth predetermined period of time t4, temperature of washing water reaches a fourth temperature T4, S10.

In other words, if it is decided that dirtiness of dishes is high as the turbidity exceeds a predetermined value, washing performance can be improved by extending the time for heating washing water by operating the heater 20 during the main wash routine. And by setting the operation time of the heater 20 during the heated rinsing routine to be shorter than that of the case where the turbidity is below a predetermined value, total operation time of the heater 20 can be maintained to be constant.

Therefore, the sum of the heat energy of the heater 20 during the main wash routine and the heat energy of the heater 20 during the rinsing routine can be always kept to be constant.

INDUSTRIAL APPLICABILITY

In the dishwasher and the control method therefor of the present invention, the turbidity of washing water is measured and, if it is decided that the level of dirtiness of the tableware is low, then the time over which a heater operates during the washing routine is reduced and, instead, the time over which the heater operates during the rinsing routine is increased. This is advantageous in that it can improve the performance of the drying which is carried out after the rinsing routine. Further, if it is decided that the level of dirtiness of the tableware is high, then the time over which the heater operates during the washing routine is increased and the time over which the heater operates during the rinsing routine is reduced. This is advantageous in that the washing performance can be improved while the overall heater operating time can be maintained.

What is claimed is:

1. A method for controlling a dishwasher, wherein the dishwasher includes a washing tub in which dishes are loaded, a sump disposed in a lower part of the washing tub to store wash water temporarily, a heater disposed within the sump to heat the wash water, and a turbidity sensor disposed within the sump to measure turbidity of the wash water, comprising:

measuring the turbidity of the wash water;

performing a main washing cycle to supply washing water to the washing tub and turn on the heater during a first predetermined period; and performing a heating rinsing cycle to supply wash water to the washing tub and turn on the heater during a second predetermined period, wherein the first predetermined period and the second predetermined period change in accordance with the turbidity of the wash water and the periods are related such that if one of the periods increases, the other of the periods decreases.

2. The method of claim 1, wherein, if the turbidity measured during the measuring turbidity step is below a predetermined value, the first predetermined period is reduced.

3. The method of claim 1, wherein, if the turbidity measured during the measuring turbidity step exceeds a predetermined value, the first predetermined period is increased.

4. The method of claim 1, wherein, the first predetermined period is proportional to the turbidity measured during the measuring turbidity step.

5. The method of claim 1, wherein, the second predetermined period is inversely proportional to the turbidity measured during the measuring turbidity step.

6. The method of claim 1, wherein before the measuring turbidity step, further comprises performing a preliminary washing providing wash water while the heater is turned off.

7. The method of claim 2, wherein, if the turbidity measured during the measuring turbidity step is below a predetermined value, the second predetermined period is increased.

8. A method for controlling a dishwasher, comprising:

performing a preliminary washing cycle by turning off a heater and washing dishes;

measuring turbidity of wash water after the preliminary washing cycle has been carried out;

performing a main washing cycle, wherein, if the turbidity measured at the measuring turbidity step is below a predetermined value, the heater is turned on for a first predetermined period and if the turbidity measured during the measuring turbidity step exceeds the predetermined value, the heater is turned on for a third predetermined period longer than the first predetermined period;

performing a plain rinsing cycle by turning off the heater and rinsing dishes after the main wash cycle; and performing a heating rinsing cycle rinsing dishes wherein, if the turbidity measured during the measuring turbidity step is below a predetermined value, the heater is turned on for a second predetermined period and if the turbidity measured during the measuring turbidity step exceeds the predetermined value, the heater is turned on for a fourth predetermined period which is shorter than the second predetermined period.

9. The method of claim 8, wherein a sum of the first predetermined period and the second predetermined period is controlled to be equal to a sum of the third predetermined period and the fourth predetermined period.

10. The method of claim 8, wherein, if the performing a plain rinsing cycle step is completed, further comprising drying the dishes.

* * * * *